US007201474B2

(12) United States Patent
Kobayashi et al.

(10) Patent No.: US 7,201,474 B2
(45) Date of Patent: Apr. 10, 2007

(54) LIQUID DELIVERING APPARATUS AND METHOD OF PRODUCING THE SAME

(75) Inventors: Kazuo Kobayashi, Kakamigahara (JP); Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 180 days.

(21) Appl. No.: 10/865,878

(22) Filed: Jun. 14, 2004

(65) Prior Publication Data

US 2005/0012790 A1 Jan. 20, 2005

(30) Foreign Application Priority Data

Jul. 15, 2003 (JP) ..... 2003-197350

(51) Int. Cl.
*B41J 2/045* (2006.01)

(52) U.S. Cl. ..... 347/72

(58) Field of Classification Search ..... 347/68, 347/70–72; 29/25.35
See application file for complete search history.

(56) References Cited

U.S. PATENT DOCUMENTS 5,376,856 A * 12/1994 Takeuchi et al. ..... 310/328
5,818,482 A * 10/1998 Ohta et al. ..... 347/70
2002/0113846 A1 8/2002 Wang et al.
2002/0174542 A1 11/2002 Watanabe et al.
2003/0103116 A1 6/2003 Sugahara et al.

FOREIGN PATENT DOCUMENTS

| | | |
|---|---|---|
| EP | 0786345 A2 | 7/1997 |
| JP | A-11-254681 | 9/1999 |
| JP | B2-3232632 | 9/2001 |
| JP | B 3258727 | 12/2001 |
| JP | A-2003-165216 | 6/2003 |

* cited by examiner

*Primary Examiner*—An H. Do
(74) *Attorney, Agent, or Firm*—Oliff & Berridge, PLC

(57) ABSTRACT

A liquid delivering apparatus includes at least one piezoelectric element which deforms upon application of a drive voltage thereto, an oscillating plate on which the piezoelectric element is laminated and which is oscillated by deformation of the piezoelectric element, and at least one liquid chamber which stores liquid and which is formed adjacent to the oscillating plate on one of opposite sides thereof that is remote from the piezoelectric element. The liquid in the liquid chamber is given pressure by the deformation of the piezoelectric element, so that the liquid is delivered to an exterior of the apparatus. The liquid chamber is formed in a laminated member including a first layer and a second layer bonded integrally to each other. At least one portion of the first layer is recessed. At least one portion of the second layer is exposed.

15 Claims, 7 Drawing Sheets

LIQUID DELIVERING APPARATUS AND METHOD OF PRODUCING THE SAME

The present application is based on Japanese Patent Application No. 2003-197350 filed Jul. 15, 2003, the contents of which are incorporated herein by reference.

BACKGROUND OF THE INVENTION

1. Field of the Invention

The present invention relates in general to a liquid delivering apparatus and in particular to such a liquid delivering apparatus including a laminated member in which at least one liquid chamber is formed and which includes an oscillating plate, wherein the liquid in the liquid chamber is given sufficient pressure by at least one piezoelectric element even where the piezoelectric element is driven by a relatively low drive voltage, so that the apparatus is capable of delivering or transporting the liquid from the liquid chamber to an exterior of the apparatus. The present invention also relates to a method of producing the liquid delivering apparatus.

2. Discussion of Related Art

As one example of an apparatus which delivers a liquid by actuation of a piezoelectric element, there are known various ink jet recording heads for use on an ink jet recording apparatus. JP-A-11-254681 discloses one example of such an ink jet recording head and a method of producing the same. The ink jet recording head disclosed in the Publication includes a reservoir in which ink supplied from an exterior is stored, a pressure generating chamber to which the ink is supplied from the reservoir via an ink supply port, a closure member (elastic plate) disposed on one of opposite sides of the pressure generating chamber, and a piezoelectric oscillating element. In the disclosed ink jet recording head, the elastic plate is deformed toward the pressure generating chamber by operation of the piezoelectric oscillating element, thereby pressurizing the ink in the pressure generating chamber, so that the ink flowed into a nozzle opening via a nozzle communication hole formed at one of opposite ends of the pressure generating chamber is ejected from the nozzle opening as a droplet.

The pressure generating chamber is located adjacent to an ink-supply-port forming substrate that is provided by a clad member including a first metal layer, a second metal layer formed of a material which has a resistance to corrosion with respect to an etching agent by which the first metal layer is etched, and a third metal layer which has a resistance to corrosion with respect to the ink, the first through third metal layers being laminated or superposed on each other. At a region of the clad member opposed to the reservoir, there is formed a thin-walled portion that is given by the second and third layers. More specifically described, the first layer corresponding to the region is removed by etching so as to form a recess whose bottom is defined by the thin-walled portion.

When the ink in the pressure generating chamber is pressurized, the ink in the pressure generating chamber flows back into the reservoir. In this case, the pressure of the ink in the reservoir may be increased. In the disclosed ink jet recording head, the above-described thin-walled portion is elastically deformed by the pressure of the ink flowed back into the reservoir, thereby avoiding an increase of the ink pressure in the reservoir. Thus, the variation of the pressure of the ink is prevented from propagating to adjacent pressure generating chambers via the reservoir, thereby avoiding deterioration of ink droplet ejecting characteristics of the head due to the pressure variation.

SUMMARY OF THE INVENTION

In the disclosed ink jet recording head, however, the above-described recess whose bottom serves as the thin-walled portion is formed in the clad member. The pressure generating chamber is not formed in the clad member. In the meantime, there is a demand for an ink jet recording head which exhibits good ink ejection characteristics even when the piezoelectric element is driven by a relatively low voltage. If the rigidity of the elastic plate is decreased with a decrease in the thickness thereof, the elastic plate can be oscillated by applying a relatively low drive voltage. Further, where the piezoelectric element has a small thickness, the voltage applied thereto can be lowered.

The thin piezoelectric element having the small thickness is generally formed by applying, to a sheet material (closure member) as a base, a paste-like piezoelectric material, according to a doctor blade method or a screen printing method. Since the conditions under which the thin piezoelectric element is formed by those methods are severe, the material (for the closure member, for instance, on which the piezoelectric element is to be formed) is required to have certain degrees of heat resistance and shock resistance. Therefore, it is difficult to produce the desired thin piezoelectric element by simply employing a conventional method in a conventional structure.

It is therefore a first object of the present invention to provide a liquid delivering apparatus including a laminated member in which at least one liquid chamber is formed and which includes an oscillating plate, wherein the liquid in the liquid chamber is given sufficient pressure by at least one piezoelectric element even where the piezoelectric element is driven by a relatively low drive voltage, so that the apparatus is capable of delivering the liquid from the liquid chamber to an exterior of the apparatus.

It is a second object of the present invention to provide a method of producing the liquid delivering apparatus of the invention.

The first object indicated above may be achieved according to a first aspect of the present invention, which provides a liquid delivering apparatus comprising at least one piezoelectric element which deforms upon application of a drive voltage thereto, an oscillating plate on which the at least one piezoelectric element is laminated and which is oscillated by deformation of the at least one piezoelectric element, and at least one liquid chamber which stores liquid and which is formed adjacent to the oscillating plate on one of opposite sides thereof that is remote from the at least one piezoelectric element. The liquid in the liquid chamber is given pressure by the deformation of the at least one piezoelectric element, so that the liquid is delivered to an exterior of the apparatus. The at least one liquid chamber is formed in a laminated member including a first layer and a second layer that are bonded integrally to each other, such that at least one portion of the first layer corresponding to the at least one liquid chamber is recessed by etching to such an extent that at least one portion of the second layer corresponding to the at least one portion of the first layer is exposed. The second layer constitutes the oscillating plate and has resistance to conditions under which the first layer is etched.

In the liquid delivering apparatus constructed according to the above-described first aspect of the present invention wherein the at least one liquid chamber is formed by etching the first layer of the laminated member, the depth of the chamber is defined by the thickness of the first layer, so that the liquid chamber has an accurate depth, permitting the apparatus to deliver the liquid with high accuracy. When the liquid in the liquid chamber is given pressure by deformation of the piezoelectric element, the amount of the liquid delivered from the liquid chamber to the exterior of the apparatus may not be accurate if the liquid chamber has an error in the configuration and the volume thereof. Where the at least one liquid chamber includes a plurality of liquid chambers, the present apparatus which permits the liquid chamber to have an accurate depth and configuration assures stable and accurate delivery of the liquid.

In the present apparatus constructed as described above, since the at least one piezoelectric element is formed on the oscillating plate reinforced by the first layer, the oscillating plate is prevented from being deformed when a stress is given to the oscillating plate upon forming of the piezoelectric element thereon. According to this arrangement, even where a laminated member is used whose second layer functioning as the oscillating plate is constituted by a thin metal layer, the piezoelectric element is laminated, with high stability, on the second layer as the oscillating plate, permitting the liquid delivering apparatus to deliver the liquid with high stability and reliability with the piezoelectric element being driven at a relatively low voltage.

The second object indicated above may be achieved according to a second aspect of the invention, which provides a method of producing at least one liquid delivering apparatus each including at least one piezoelectric element which deforms upon application of a drive voltage thereto and at least one liquid chamber which stores liquid and which is formed so as to be opposed to said at least one piezoelectric element, the liquid in the liquid chamber being given pressure by deformation of the at least one piezoelectric element, so that the liquid is delivered to an exterior of the at least one liquid delivering apparatus. The method comprises a laminated-member forming step, a liquid-chamber-forming step, and a piezoelectric-layer forming step. In the laminated-member forming step, a laminated member including a first layer and a second layer that are bonded integrally to each other is formed. The second layer has resistance to conditions under which the first layer is etched. In the liquid-chamber forming step, the at least one liquid chamber is formed such that the laminated member formed in the laminated-member forming step is etched under the conditions that only the first layer is substantially etched, so that at least one portion of the first layer which correspond to the at least one liquid chamber is removed to such an extent that at least one portion of the second layer corresponding to the at least one portion of the first layer is exposed, for thereby forming the at least one liquid chamber. The second layer constitutes an oscillating plate and the at least one portion of the second layer from which the at least one portion of the first layer has been removed functions as an oscillating portion of the oscillating plate which is oscillated by deformation of the at least one piezoelectric element. In the piezoelectric-layer forming step, at least one piezoelectric layer is formed as the at least one piezoelectric element on one of opposite surfaces of the second layer of the laminated member that is remote from the first layer. The piezoelectric-layer forming step is carried out prior to or after the liquid-chamber forming step.

In the method according to the above-described second aspect of the invention, in the liquid-chamber forming step, the second layer functions as an etching stopper and only the first layer is etched. Accordingly, the liquid chamber having an accurate depth and configuration can be formed with high accuracy. Where the at least one liquid chamber includes a plurality of liquid chambers, the present method which permits formation of the liquid chamber having an accurate depth and configuration assures stable and accurate delivery of the liquid. In the piezoelectric-layer forming step, the piezoelectric element is formed on the second layer which is in a state in which its rigidity is increased since the second layer is reinforced or backed by the first layer. Accordingly, even if a stress acts on the second layer when the piezoelectric element is formed thereon, the second layer can withstand the stress and does not suffer from deformation, so that the first layer and the second layer can be kept bonded with high stability without being separated from each other. In particular when the piezoelectric-layer forming step is carried out prior to the liquid-chamber forming step, in other words, the piezoelectric element is formed on the second layer that is reinforced by the first layer in which the liquid chambers are not yet formed, the first layer and the second layer can be kept bonded with further improved stability even after the first and second layers are subjected, in the piezoelectric-layer forming step, to very severe treating conditions such as the heat treatment conducted at a relatively high temperature where the organic substance is decomposed.

Further, in the present arrangement described above, even where a laminated member is used whose second layer functioning as the oscillating plate is constituted by a thin metal layer, the piezoelectric element is laminated, with high stability, on the second layer (as the oscillating plate) that is reinforced by the first layer, so that the liquid delivering apparatus is capable of to delivering the liquid with high stability and reliability with the piezoelectric element being driven at a relatively low voltage.

The features recited in claims relating to the liquid delivering apparatus according to the first aspect described above are true of the method described above.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
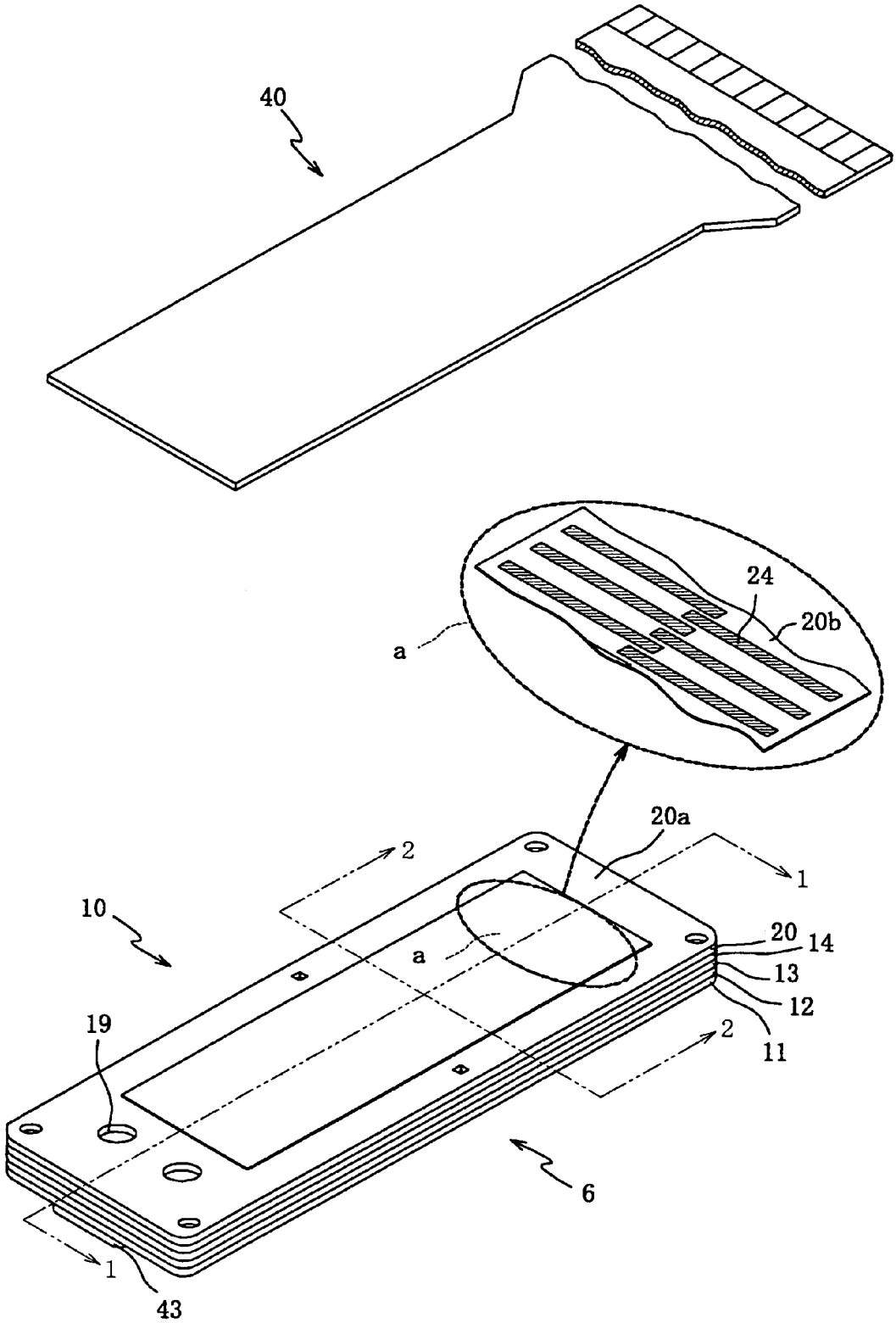
FIG. 1 is an exploded perspective view of a piezoelectric ink jet recording head constructed according to the present invention.
Figure 2A:
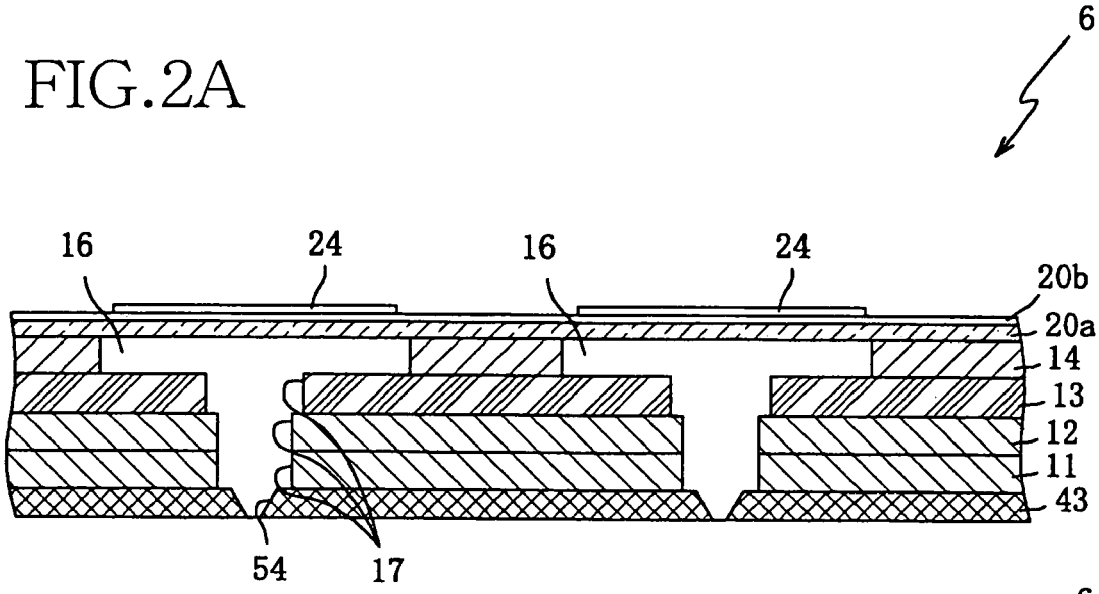
FIG. 2A is a cross sectional view taken along line 1—1 of FIG. 1, of the ink jet recording head of FIG. 1.
Figure 2B:
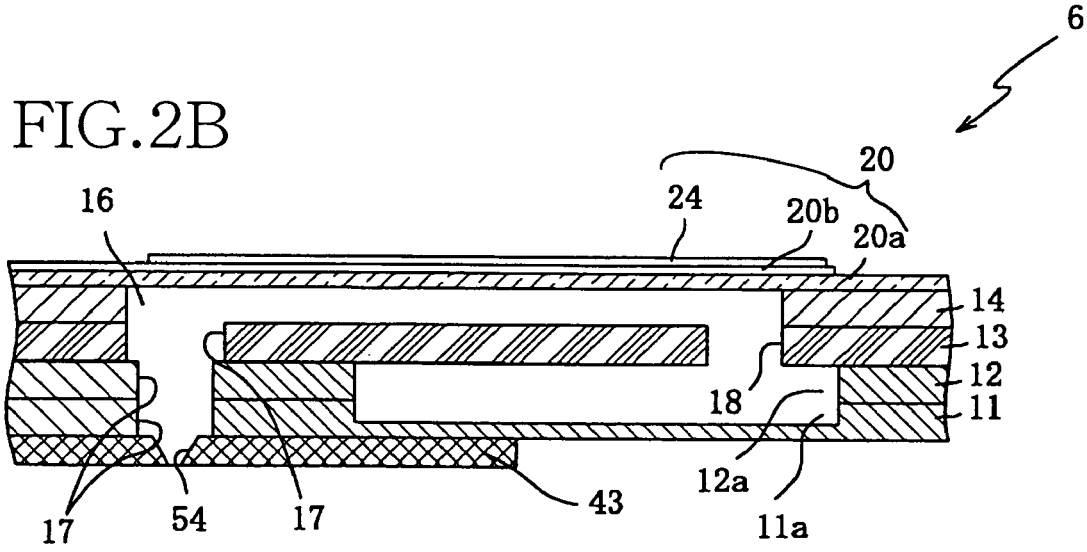
FIG. 2B is a cross-sectional view taken along line 2—2 of FIG. 1, of the ink jet recording head of FIG. 1.

Referring to the drawings, there will be described preferred embodiments of the present invention.

Referring first to FIG. 1 of the exploded perspective view, there is shown a liquid delivering apparatus in the form of a piezoelectric ink jet recording head 6 constructed according to a method as one embodiment of the present invention.

As shown in. FIG. 1, the piezoelectric ink jet recording head 6 has a laminated structure including a piezoelectric element 20*b*, an oscillating plate 20*a*, a cavity plate 14, a spacer plate 13, two manifold plates (second and first manifold plates) 12, 11, and a nozzle plate 43, which are arranged in this order in a direction from the top to the bottom of the head 6.

The piezoelectric element 20*b*, the oscillating plate 20*a* and a plurality of individual electrodes 24 (which will be described) cooperate with each other to provide a pressure applying member 20. The cavity plate 14, spacer plate 13, two manifold plates 11, 12, and nozzle plate 43 cooperate to provide an ink storing portion 10.

Each of the plates 11, 12, 13, 14, 43 which provide the ink storing portion 10 has a thickness of about 50 μm to about 150 μm.

Figure 3:
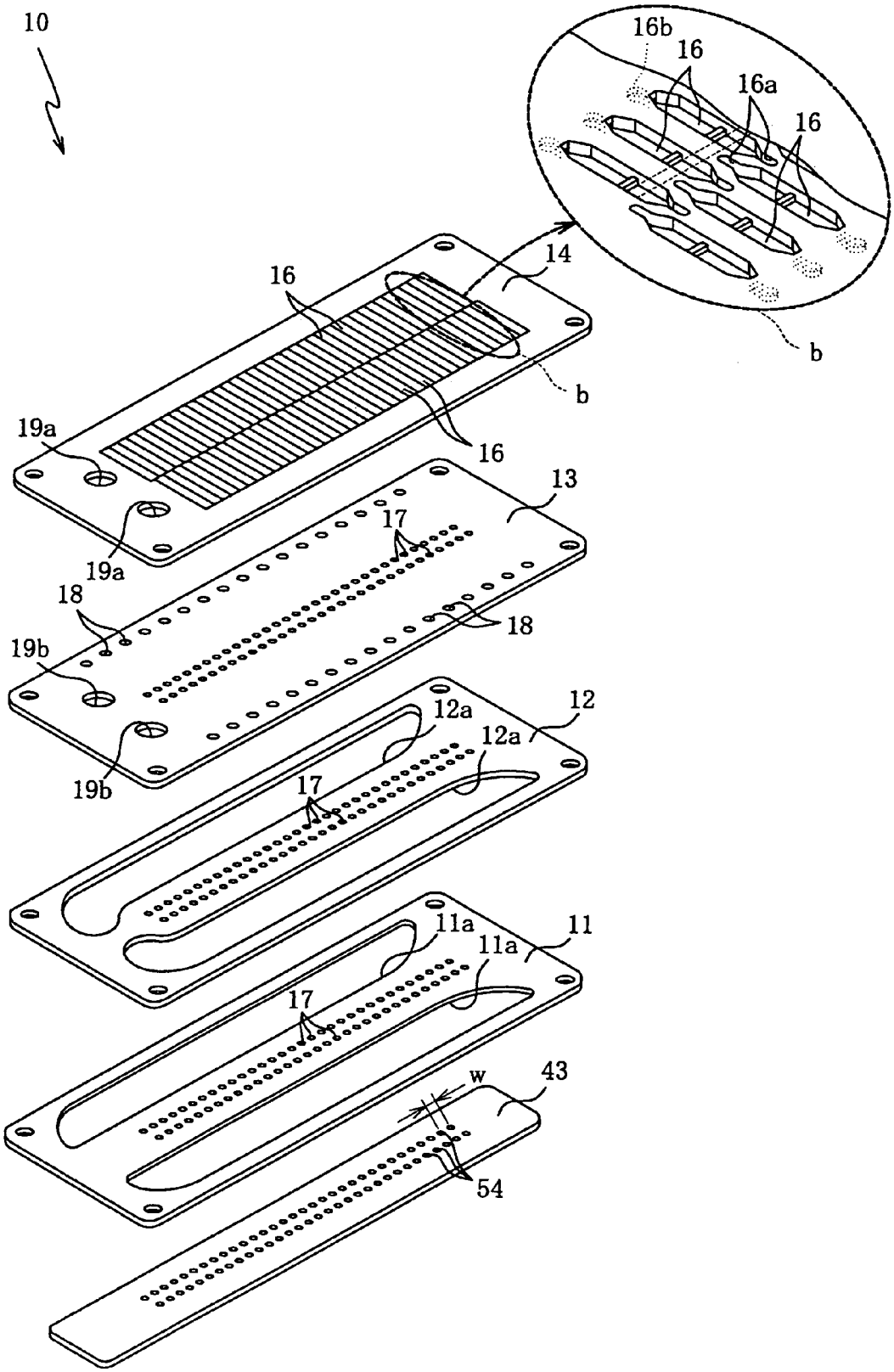
FIG. 3 is an exploded perspective view of an ink storing portion of the ink jet recording head of FIG. 1.

The nozzle plate 43 as the lowermost layer of the ink storing portion 10 is an elongate plate member formed of synthetic resin. The nozzle plate 43 has a multiplicity of ink ejection nozzles 54 each having an extremely small diameter. The nozzles 54 are formed through the thickness of the nozzle plate 43, in two straight rows extending in a longitudinal direction (i.e., a first direction) of the nozzle plate 43, such that the nozzles 54 of each row are equally spaced apart from each other at a relatively small spacing pitch "w" (FIG. 3) and such that each of the nozzles 54 of one of the two rows is interposed between the adjacent two nozzles 54 of the other row in the longitudinal direction of the nozzle plate 43. Thus, the nozzles 54 are formed in the two rows, in a zigzag or staggered manner.

The first manifold plate 11 is an elongate plate member stacked on an upper surface of the nozzle plate 43 and has, in its upper surface, a pair of manifold recesses 11*a*, 11*a* that are open upward.

The second manifold plate 12 is an elongate plate member stacked on the upper surface of the first manifold plate 11 and has a pair of manifold openings 12*a*, 12*a* each as part of an ink channel. The two manifold openings 12*a*, 12*a* are formed through the thickness of the second manifold plate 12 such that the two manifold openings 12*a*, 12*a* extend on opposite sides of the two straight rows of the nozzles 54, respectively. The manifold openings 12*a*, 12*a* formed in the second manifold plate 12 are respectively aligned with the manifold recesses 11*a*, 11*a* formed in the first manifold plate 11 and have the substantially same shape in their plan view as that of the manifold recesses 11*a*, 11*a*. Each of the two manifold openings 12*a*, 12*a* cooperates with a corresponding one of the two manifold recesses 11*a*, 11*a* to define a manifold chamber. Each of the manifold openings 12*a*, 12*a* is aligned in its plan view with a corresponding one of two rows of liquid chambers 16 (which will be described) formed in the cavity plate 14, such the each manifold opening 12*a* extends over the corresponding row of liquid chambers 16 that extend in a longitudinal direction of the cavity plate 14.

The cavity plate 14 located above the second manifold plate 12 with the spacer plate 13 being interposed therebetween is an elongate plate member functioning as the uppermost layer of the ink storing portion 10. The cavity plate 14 has two rows of liquid chambers 16 formed through the thickness thereof such that the two rows of liquid chambers 16 extend along a centerline of the cavity plate 14 that is parallel to the longitudinal direction (i.e., a first direction) of the cavity plate 14. In a state in which the plates 11, 12, 13, 14 are stacked on each other, the upper portion of each liquid chamber 16 which is remote from the spacer plate 13 is in an open state.

The two rows of the liquid chambers 16 are located on the respective opposite sides of the centerline of the cavity plate 14. Each of the liquid chambers 16 of one of the two rows is interposed between adjacent liquid chambers 16 of the other row in the direction of extension of the rows. Each liquid chamber 16 has an elongate shape that extends in a second direction (i.e., a transverse direction) of the cavity plate 14 that is perpendicular to the above-indicated centerline thereof.

Respective inner ends 16*a* of the liquid chambers 16 communicate with the corresponding nozzles 54 of the nozzle plate 43 via respective small-diameter through-holes 17 that are formed in two rows in a zigzag manner through the thickness of each of the space plate 13 and the first and second manifold plates 11, 12. On the other hand, respective outer ends 16*b* of the liquid chambers 16 of one of the two rows communicate with a corresponding one of the two manifold chambers of the manifold plates 11, 12 via a corresponding one of two rows of through-holes 18 that are formed through the thickness of the spacer plate 13 such that the rows of the through-holes 18 are respectively located near opposite long side edges of the spacer plate 13; and respective outer ends 16*b* of the liquid chambers 16 of the other row communicate with the other manifold chamber via the other row of through-holes 18 of the spacer plate 13. As shown in an enlarged view (an encircled portion "b") in FIG. 3, the respective outer ends 16*b* of the liquid chambers 16 of the two rows are formed in a lower surface of the cavity plate 14 such that the outer ends 16*b* are open only downward.

The oscillating plate 20*a* has, at one of its longitudinally opposite end portions, two supply holes 19, 19 that are formed through the thickness thereof, the cavity plate 14 has, at one of its longitudinally opposite end portions, two supply holes 19*a*, 19*a* that are formed through the thickness thereof; and the spacer plate 13 has, at one of its longitudinally opposite end portions, two supply holes 19*b*, 19*b* that are formed through the thickness thereof. The supply holes 19, 19 of the oscillating plate 20*a*, the supply holes 19*a*, 19*a* of the cavity plate 14, and the supply holes 19*b*, 19*b* of the spacer plate 13 are aligned with each other in the direction of stacking of the plates and communicate with the two manifold openings 12*a*, 12*a* of the second manifold plate 12, The ink supplied from the ink cartridge to the two manifold chambers 11*a*, 12*a*; 11*a*, 12*a* via the supply holes 19, 19*a*, 19*b* is distributed to the liquid chambers 16 via the respective through-holes 18, and then reach, via the through-holes 17, the nozzles 54 corresponding to the liquid chambers 16.

The pressure applying member 20 is for changing the volume of each liquid chamber 16 formed in the ink storing portion 10, and functions as a piezoelectric actuator that is operated by application thereto of an electric voltage. The pressure applying member 20 is superposed on an upper surface of the ink storing portion 10 (i.e., the upper surface of the cavity plate 14 as the uppermost layer of the ink storing portion 10), and has a rectangular shape that closes the upper openings of all of the liquid chambers 16. The pressure applying member 20 is constituted by the oscillating plate 20*a* which is a metal plate member, the piezoelectric element 20*b* which is provided on one of opposite surfaces of the oscillating plate 20*a* that is remote form the ink storing portion 10 and which oscillates the oscillating plate 20*a*, and the plurality of individual electrodes 24 provided on an upper surface of the piezoelectric element 20*b*.

The piezoelectric element 20*b* is formed on the above-indicated one surface of the oscillating plate 20*a* and is a stress producing member for producing a stress in the oscillating plate 20*a* and thereby deforming the same 20*a*. The piezoelectric element 20*b* is formed by using, as a major component, lead zirconium titanate (hereinafter simply referred to as "PZT") which is solid solution of lead titanate and lead zirconate and which is ferroelectric. The piezoelectric element 20*b* has a thickness of about 3 μm to about 20 μm. The ferroelectric PZT is polarized, by application of a voltage thereto, in one specific direction, and is kept polarized after the application of the voltage is stopped. Namely, the polaraization (residual dielectric polarization) remains in the PZT. When a voltage is applied to the polarized PZT, the PZT undergoes a strain. In the present embodiment, the PZT (piezoelectric element 20*b*) is polarized such that the direction of polarization is perpendicular to a plane of the oscillating plate 20*a*.

The thickness of the piezoelectric element 20*b* has an optimum range with respect to the thickness (rigidity) of the oscillating plate 20*a*. With an increase in the thickness (rigidity) of the oscillating plate 20*a*, a larger force is needed for deforming the oscillating plate 20*a*. If the thickness of the piezoelectric element 20*b* is increased, the force to be generated by the piezoelectric element 20*b* can be increased if the field intensity is constant, but a higher electric voltage is needed to drive the piezoelectric element 20*b*.

In conventional piezoelectric actuators, there have been employed a piezoelectric element having a thickness of not smaller than about several tens of microns (μm), for instance. The piezoelectric element having such a thickness is formed by first providing a green sheet of the PZT by the doctor blade method or screen printing method, and then firing the green sheet. In such methods, it is difficult to form a piezoelectric element having a thickness in a range from several microns (μm) to about 10 μm. Therefore, the conventional piezoelectric actuators need a high drive voltage. In the meantime, a chemical vapor deposition method and a sputtering method are employed for forming a layer whose thickness is about 1 μm. While the chemical vapor deposition method and the sputtering method may be employed in the present invention, the following methods are suitably employed in the present invention to cause a sufficiently large stress in the oscillating plate 20*a*.

In the present invention, an aerosol deposition method (hereinafter simply referred to as "AD method") or a sol-gel method is suitably employed for forming the piezoelectric element 20*b*. The AD method and sol-gel method will be explained in greater detail by referring to FIGS. 4–6.

Since the oscillating plate 20*a* is provided by a clad or laminated member in which the oscillating plate 20*a* and the cavity plate 14 are laminated or superposed integrally on each other as described below, the oscillating plate 20*a* has a size that covers the entirety of one of opposite major surfaces of the cavity plate 14. The piezoelectric element 20*b* in the present embodiment, however, is formed over only a region of one of opposite major surfaces of the oscillating plate 20*a*, which region corresponds to the plurality of liquid chambers 16 formed in the cavity plate 14. The piezoelectric element 20 may be individually formed for each of the liquid chambers 16 or over the entirety of the above-indicated one major surface of the oscillating plate 20*a*.

On the upper surface of the piezoelectric element 20*b* (i.e., one of opposite major surfaces thereof remote from the oscillating plate 20*a*), the individual electrodes 24 are provided such that the individual electrodes 24 are aligned with the liquid chambers 16 of the cavity plate 14, respectively. More specifically described, as shown in an enlarged view (encircled portion "a") in FIG. 1, the individual electrodes 24 are arranged in two rows in a zigzag manner in a first direction (i.e., a longitudinal direction) of the piezoelectric element 20*a*, and each of the individual electrodes 24 is in the form of an elongate strip that extends from a widthwise central portion of the piezoelectric element 20*b* toward a second direction perpendicular to the first direction. In the present embodiment, the width of each individual electrode 24 is slightly smaller than that of each liquid chamber 16, in their plan view.

The oscillating plate 20*a* is formed of an electrically conductive metal material, and cooperates with the individual electrodes 24 to sandwich the piezoelectric element 20*b* therebetween. The oscillating plate 20*a* functions as a common electrode which is common to all liquid chambers 16.

On the upper surface of the pressure applying member 20, there is superposed a flexible flat cable 40 having a plurality of wires (not shown) which are connected to the individual electrodes 24, respectively, independent of each other. Each individual electrode 24 is electrically connected to a power source and a signal source (both not shown) via the respective wires.

When an electric voltage higher than that applied when a normal or usual ink ejection operation is conducted is applied between all individual electrodes 24 and the oscillating plate 20*a* via the flexible flat cable 40, respective portions in the piezoelectric element 20*b* which are interposed between the individual electrodes 24 and the oscillating plate 20*a* are polarized, thereby providing active portions that undergo a strain when the electric voltage for the ink ejection operation is applied thereto. Where the piezoelectric element 20*b* is formed over the region corresponding to all liquid chambers 16 as in the present embodiment or where the piezoelectric element 20*b* is formed over the entirety of one major surface of the oscillating plate 20*a*, the piezoelectric element 20*b* includes a plurality of active portions. Where the piezoelectric element 20*b* is formed for each of the liquid chambers 16, the piezoelectric element 20*b* constitutes the active portion. Respective portions of the oscillating plate 20*a* which correspond to the respective active portions and which correspond to the respective liquid chambers 16 formed in the cavity plate 14 by etching as described below function as oscillating portions which are oscillated by deformation of the active portions. The oscillating plate 20*a* and the cavity plate 14 are provided by a plate-like metal member, i.e., a laminated member or a clad member in which the two plates 20*a*, 14 are integrally bonded to each other. The oscillating plate 20*a* as a first metal member of the clad member is a rolled metal sheet having a thickness of about 10 μm to about 50 μm while the cavity plate 14 as a second metal member of the clad member is formed with the plurality of liquid chambers 16 by etching.

Since the oscillating plate 20*a* and the cavity plate 14 are provided by an integral clad member, the oscillating plate 20*a* needs to have a resistance to etching by which the liquid members 16 are formed in the cavity plate 14. In view of this, the combination of respective materials for the oscillating plate 20*a* and the cavity plate 14 is determined depending upon a degree of solubility with respect to an etching agent used for forming the liquid chambers 16. For instance, where the oscillating plate 20*a* is formed of titanium alloy, the cavity plate 14 is formed of any one of stainless steel, aluminum alloy, and nickel alloy.

The combination of the materials for the oscillating plate 20*a* and the cavity plate 14 may be determined depending upon the ionization tendency or the corrosion potential. While taking into account the galvanic corrosion, the oscillating plate 20*a* may be formed of a metal whose ionization tendency is smaller than that of a metal for the cavity plate 14, i.e., whose corrosion potential is higher than that of the metal for the cavity plate 14.

Each liquid chamber 16 is formed by etching the cavity plate 14 with an etching agent, such that one of opposite openings of each liquid chamber 16 is open in the lower surface of the cavity plate 14 while the other opening is closed by the oscillating plate 20*a*, so that the liquid chambers 16 each in the form of a recess are formed. Namely, the depth of each liquid chamber 16 (i.e., the height of the chamber 16 as seen in the direction of lamination of the oscillating plate 20*a* and the cavity plate 14) is made equal to the thickness of the cavity plate 14, with high accuracy.

In the present embodiment, the plate-like metal members used for the plates 11–13, respectively, are formed of stainless steel, nickel alloy, etc., and are bonded to each other with an epoxy resin type adhesive or by diffusion bonding.

In the thus constructed piezoelectric ink jet recording head 6, when a voltage is applied to an arbitrary individual electrode 24 via the flexible flat cable 40 (while the individual electrode 24 is connected to a positive electrode and the oscillating plate 20*a* is connected to the ground), an electric field is produced in the same direction as the polarization direction. Accordingly, the active portion located immediately below the individual electrode 24 to which the voltage is applied is selectively driven, so that the active portion contracts in a direction perpendicular to the polarization direction. In this case, since the oscillating plate 20*a* does not contract, the active portion of the piezoelectric element 20*b* and the corresponding oscillating portion of the oscillating plate 20*a* are deformed, in the present embodiment, toward the oscillating plate 20*a*, namely, deformed into a convex shape which protrudes toward the corresponding liquid chamber 16.

As a result, the liquid chamber 16 is selectively pressurized, and the volume of that liquid chamber 16 is decreased. Accordingly, the pressure of the ink in the liquid chamber 16 is increased, and the pressure of the ink propagates to the corresponding nozzle 54, so that a droplet of the ink is ejected from the nozzle 54. When the application of the voltage is stopped, the active portion of the piezoelectric element 20*b* and the oscillating portion of the oscillating plate 20*a* which have been deformed return to the original state, and the volume of the liquid chamber 16 returns to the original value. In this case, since the liquid chamber 16 is depressurized, the ink is sucked into the liquid chamber 16 from the ink supply portion (i.e., from an appropriate of one ink cartridge 61). Thus, the state of the ink jet recording head 6 returns to its original state in which the ink ejection operation is not conducted.

The ink kept in the piezoelectric ink jet recording head 6 (the ink before it is ejected) is subjected to a negative pressure acting thereon in a direction opposite to the direction toward which the ink is ejected. Accordingly, no ink is ejected, in a state in which no voltage is applied, from the nozzles 54 which open downwardly, and accordingly the ink delivered to the nozzles 54 forms meniscus.

Figure 4:
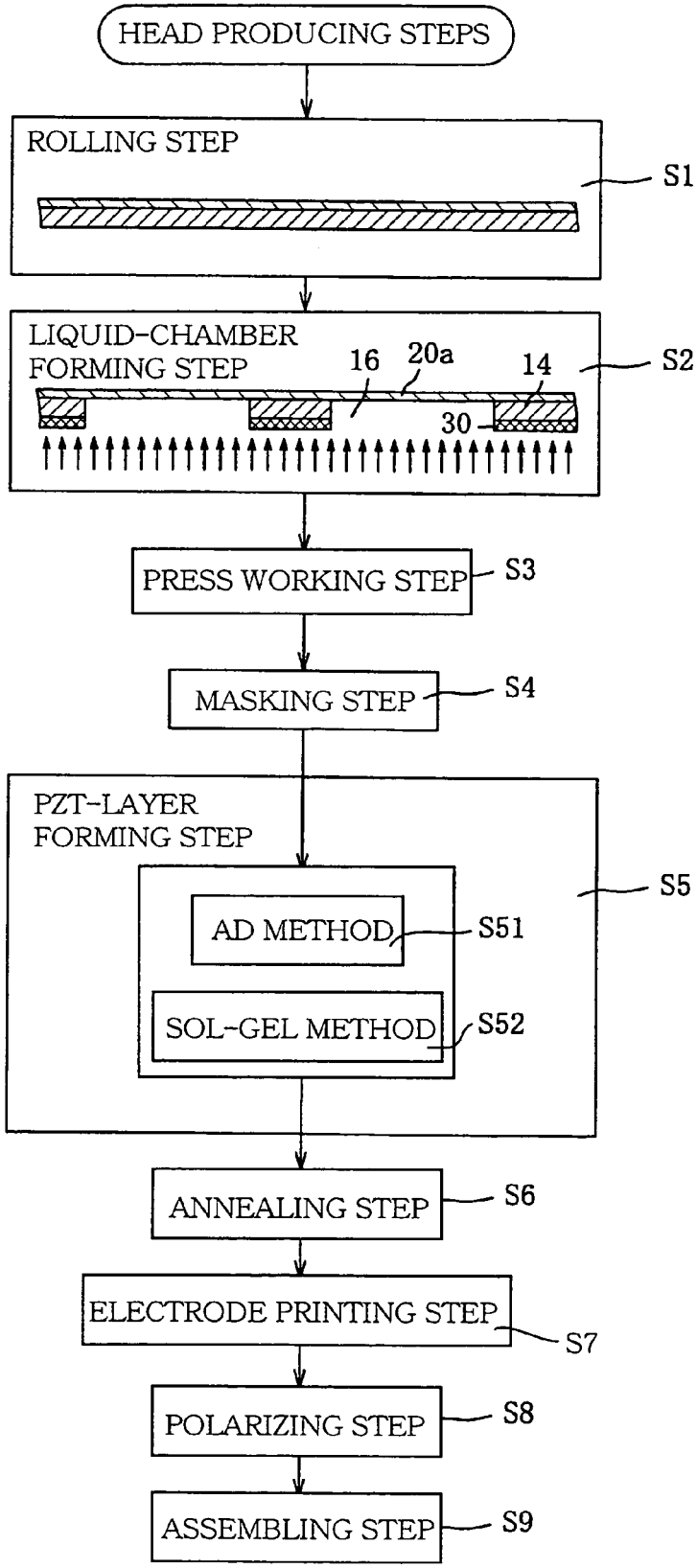
FIG. 4 is a view showing process steps for producing the piezoelectric ink jet recording head.
Figure 5:
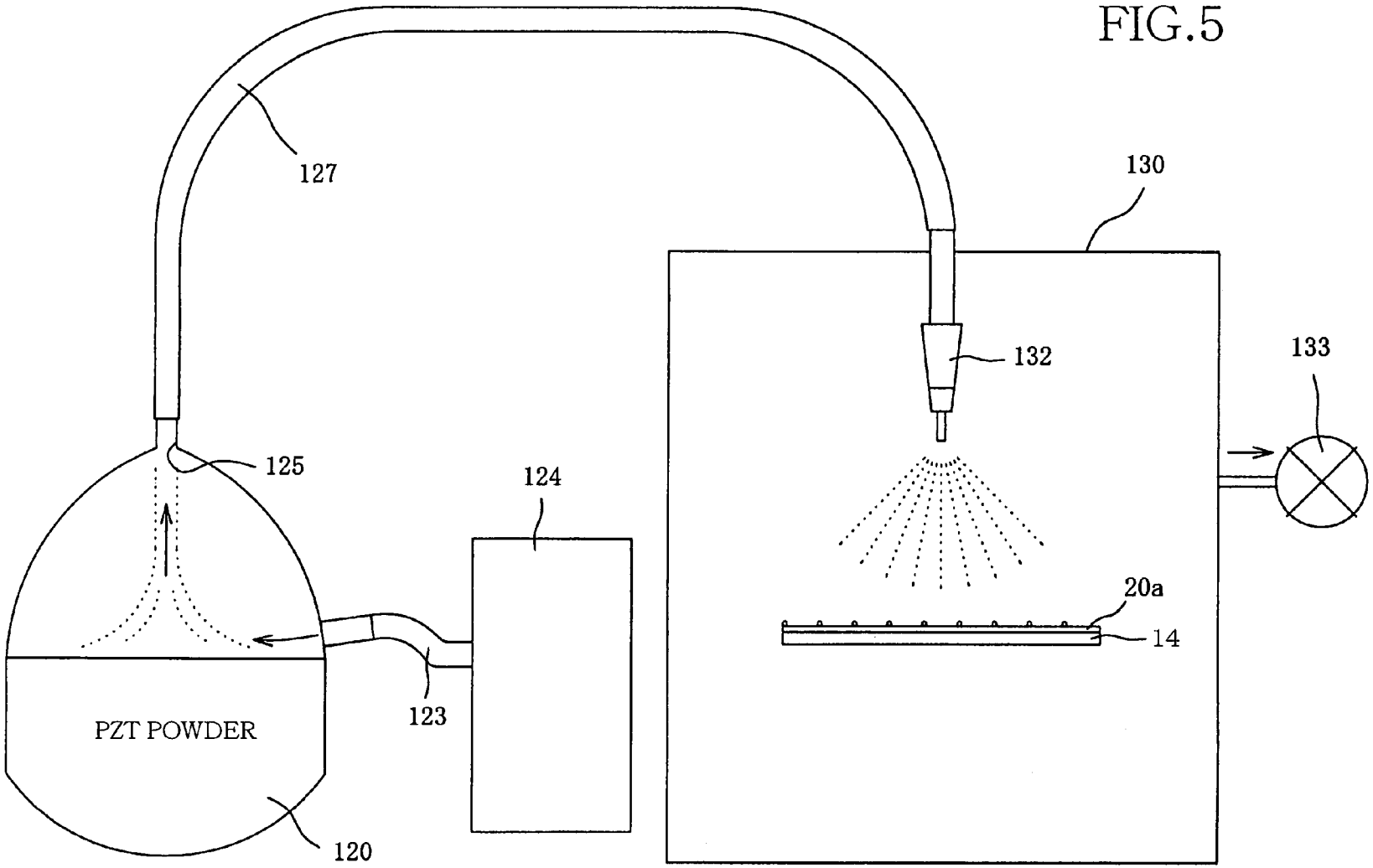
FIG. 5 is a view for explaining an aerosol deposition (AD) method as one method employed for forming the PZT film.
Figure 6:
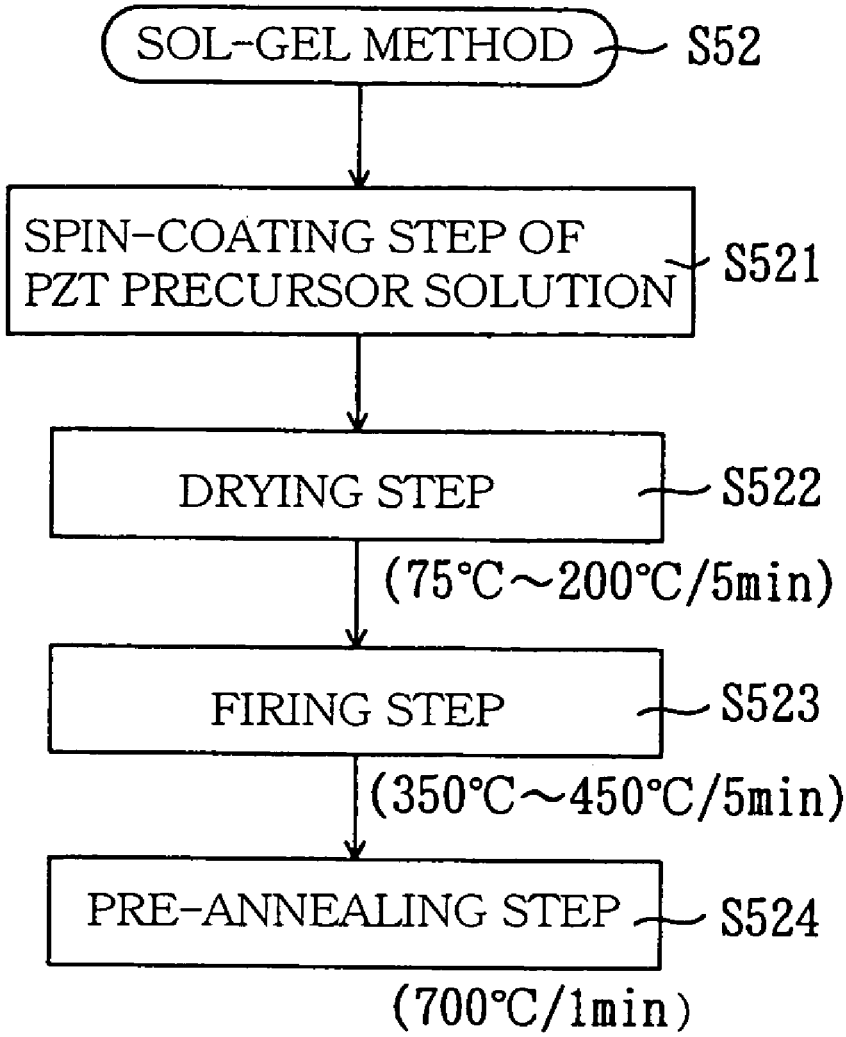
FIG. 6 is a view showing process steps of a sol-gel method as another method employed for forming the PZT film.

Referring next to FIGS. 4 to 6, there will be described a method of producing the piezoelectric ink jet recording head 6 constructed as described above.

FIG. 4 is a view showing process steps for producing the piezoelectric ink jet recording head 6 according to one embodiment of the present invention. The process steps include a rolling step (S1), a liquid-chamber forming step (S2), a press working step (S3), a masking step (S4), a PZT-layer forming step (S5), an annealing step (S6), an electrode printing step (S7), a polarizing step (S8), and an assembling step (S9). These process steps are carried out in the order of description in the present embodiment.

In the rolling step (S1), the clad member consisting of the oscillating plate 20*a* and the cavity plate 14 for the ink jet recording head 6 is produced. In this rolling step, a stainless steel member for the cavity plate 14 and a titanium alloy member for the oscillating plate 20*a* are laminated on or bonded to each other by rolling.

The rolling step (S1) is followed by the liquid-chamber forming step (S2) in which a plurality of liquid chambers 16 are formed by etching the cavity plate 14 of the clad member. Described more specifically, a resist 30 is initially formed on the surface of the stainless steel member (for the cavity plate 14) of the clad member so as to cover only portions at which the liquid chambers 16 are not formed. Then, there is sprayed or dropped an etching agent of ferric chloride which etches the stainless steel member for the cavity plate 14 and which does not etch the titanium alloy member for the oscillating plate 20*a*, in a direction as indicated by arrows shown in S2 of FIG. 4, for thereby etching non-resist regions of the cavity plate 14 (regions of the cavity plate 14 not covered with the resist 30). Thus, there are formed, with high accuracy, the plurality of liquid chambers 16 each having a width corresponding to the opening of the resist 30 and a depth corresponding to the thickness of the cavity plate 14. The resist 30 is removed from the cavity plate 14 after the etching has been finished.

The liquid-chamber forming step (S2) is followed by the press working step (S3) in which the ink supply holes 19, 19*a* are punched by using a press at predetermined positions of the oscillating plate 20*a* and the cavity plate 14.

Subsequently, the masking step (S4) is carried out to cover or mask, with a masking member, a portion of the surface of the oscillating plate 20*a* on which the piezoelectric element 20*b* is not to be formed in the following PZT-layer forming step (S5). Since the piezoelectric element 20*b* is formed via the masking member, the piezoelectric element 20*b* is not formed over the entire surface of the oscillating plate 20*a*, but only over an intended region of the surface of the oscillating plate 20*b*. In other words, the piezoelectric element 20*b* is formed over only the intended region corresponding to the plurality of liquid chambers 16 formed in the cavity plate 14.

The masking step (S4) is followed by the PZT-layer forming step (S5) for forming a piezoelectric layer as the piezoelectric element 20*b*, on the upper surface of the oscillating plate 20*a*. In this PZT-layer forming step of the present invention, the dense piezoelectric element 20*b* whose thickness is about 3 μm to about 20 μm is formed by the AD method (S51) which will be described by referring to FIG. 5, or the sol-gel method (S52) which will be described by referring to FIG. 6.

FIG. 5 is a view for explaining the AD (aerosol deposition) method (S51) as one example of the PZT-layer forming method employed in the present invention. In the AD method, a gas flow which includes fine particles of the PZT having an average diameter of submicron (smaller than 1

μm) is sprayed on a surface of the object on which the PZT film is to be formed, so as to fix the fine particles of the PZT on the surface. As shown in FIG. 5, the PZT powder is stored in a tank 120, and is blown up by a compressed gas supplied from a gas bomb 124 via a tube 123. The PZT powder blown up by the compressed gas is delivered from an opening 125 of the tank 120 to a deposition chamber 130 via a tube 127, by the compressed gas functioning as a medium or a carrier gas. The gas to be used as the delivering medium for delivering the PZT powder is, for instance, a helium gas or a nitrogen gas.

In the deposition chamber 130, the PZT powder is sprayed onto the oscillating plate 20*a*. At the ceiling portion of the deposition chamber 130, a nozzle member 132 is provided for spraying the PZT powder supplied from the tank 120 via the tube 127 in a downward direction.

A table (not shown) is positioned in the deposition chamber 130, such that the table is located below the nozzle member 132 so as to be opposed to the nozzle member 132. On the table, there is disposed the clad member, i.e., the oscillating plate 20*a* formed integrally with the cavity plate 14 in which the liquid chambers 16 have been formed in the above-described liquid-chamber forming step (S2). The table is arranged to be movable along a horizontal X-Y plane perpendicular to a direction in which the table is opposed to the nozzle member 132. The clad member is disposed on the table such that the oscillating plate 20*a* is opposed to the nozzle member 132.

A vacuum pump 133 is connected to the deposition chamber 130 so as to deaerate or degass the inside of the deposition chamber 130. When the PZT powder is sprayed onto the oscillating plate 20*a*, the inside of the deposition chamber 130 is reduced to a predetermined pressure by the vacuum pump 133.

The PZT powder delivered from the tank 120 is sprayed, at a high speed, onto the oscillating plate 20*a* as the object from the nozzle member 132. The kinetic energy of the sprayed PZT powder is converted to the thermal energy by colliding with the oscillating plate 20*a*. Owing to the thermal energy, the particles of the PZT are integrated or joined together, thereby forming the piezoelectric element 20*b* on the upper surface of the oscillating plate 20*a*. Since the clad member disposed on the table is moved along the X-Y plane, the PZT powder can be sprayed uniformly onto the upper surface of the oscillating plate 20*a*, so that the uniform, dense piezoelectric element 20*b* can be formed on the portion of the upper surface of the oscillating plate 20*a* not covered with the masking member.

In the AD method (S51), since the PZT powder needs to be sprayed onto the intended object at high speed, the object inevitably receives large impact or shock. In the present method of producing the piezoelectric ink jet recording head 6, the PZT layer (piezoelectric element 20*b*) is formed on the oscillating plate 20*a* provided by the clad member. In other words, the piezoelectric element 20*b* is formed not on the oscillating plate 20*a* as a single, separate member, but on the oscillating plate 20*a* backed or reinforced by the cavity plate 14 and having an increased rigidity. Therefore, even where the thickness of the oscillating plate 20*a* is as small as about 10 μm to about 50 μm, the oscillating plate 20*a* can sufficiently withstand the impact acting thereon when the PZT powder is sprayed.

Referring next to FIG. 6, there will be described the sol-gel method (S52) as another example of the PZT-layer forming method employed in the present invention. In the sol-gel method (S52), hydrated complex of metal hydroxide which can be used to form the piezoelectric element 20*b*, i.e., a sol is subjected to a dehydration treatment so as to provide a gel, and the obtained gel is heated and fired to provide inorganic oxide.

For forming the piezoelectric element 20*b* according to the sol-gel method (S52), respective alkoxides of titanium, zirconium, lead and other metal components are mixed with water and alcohol for hydrolysis, thereby providing a PZT precursor solution in the form of a sol composition. As shown in FIG. 6, the sol-gel method includes a spin coating step of spin coating a PZT precursor solution (S521), a drying step (S522), a firing step (S523), and a pre-annealing step (S524) which will be described.

In the spin coating step (S521), the PZT precursor solution prepared as described above is applied to the upper surface of the oscillating plate 20*a* by spin coating. The PZT precursor solution is coated on the oscillating plate 20*a* provided by the clad member described above. The coating method of the PZT precursor solution is not limited to the spin coating, but any other commonly used coating methods such as dip coating, roller coating, bar coating and screen printing may be suitably employed.

The spin coating step (S521) is followed by the drying step (S522) in which the PZT precursor solution coated on the oscillating plate 20*a* is dried at a temperature from 75° C. to 200° C. for five minutes to thereby evaporate the solvent. The PZT precursor solution may be further coated on the thus dried (heated) layer to increase its thickness.

The drying step (S522) is followed by the firing step (S523) in which the dried layer is fired at a suitable temperature for a suitable time period that permit the layer of the sol composition to be turned into the gel and permit the organic substance to be removed from the layer. In the present embodiment, the layer is fired at a temperature from 350° C. to 450° C. for five minutes. The spin coating step (S521), the drying step (S522) and the firing step (S523) are repeated for a required number of times, e.g., four or more times, so as to form a piezoelectric precursor layer having an intended thickness. By those drying and degreasing treatments, the metal alkoxides in the solution form a metal-oxide-metal network.

Subsequently, in the pre-annealing step (S524), the piezoelectric precursor layer is subjected to pre-annealing in which the piezoelectric precursor layer is crystallized by a heat treatment. In this step (S524), the piezoelectric precursor layer is fired in an oxygen atmosphere at 700° C. for one minute, so that the piezoelectric precursor layer is turned into a metal oxide layer having a perovskite crystal structure. Thus, the piezoelectric element 20*b* is formed.

In the sol-gel method (S52) described above, the heat treatments are repeatedly conducted. In this respect, where the piezoelectric element 20*b* is formed on the oscillating plate 20*a* having a thickness of about 10 μm to about 50 μm, the oscillating plate 20*a* may suffer from curling due to a difference between coefficients of thermal expansion of the oscillating plate 20*a* and the piezoelectric element 20*b*. In the present method of producing the piezoelectric ink jet recording head 6, however, the piezoelectric element 20*b* is formed not on the oscillating plate 20*a* as the single or separate member, but on the oscillating plate 20*a* which is integral with or backed by the cavity plate 14. In other words, the piezoelectric element 20*b* is formed on the oscillating plate 20*a* which is reinforced by the cavity plate 14 and whose rigidity is increased. Accordingly, even where the oscillating plate 20*a* is of thin-type having a thickness of about 10 μm to about 50 μm, the curing of the oscillating plate 20*a* is effectively avoided.

If the component under manufacture suffers from the curling or other deformation, the handling of the component undesirably becomes troublesome. In addition, the assembling step, etc., needs to be carried out while at the same time correcting or modifying the curling or deformation, inevitably deteriorating the production efficiency. Where the component suffers from the curling or deformation to an excessive extent, the component cannot be acceptable and is treated as a defective product. The method according to the present embodiment, however, effectively prevents the curling or deformation from being generated, resulting in production of the intended ink jet recording head 6 with improved yield.

After the PZT-layer forming step (S5) has been conducted, i.e., after the piezoelectric element 20*b* has been formed by the AD method (S51) or the sol-gel method (S52) described above, the annealing step (S6) is conducted for crystal growth of the PZT that constitutes the piezoelectric element 20*b* formed in the PZT-layer forming step (S5). In the annealing step (S6), a heat treatment at a high temperature is carried out. The annealing conditions are suitably determined depending upon the layer forming method employed in the PZT-layer forming step (S5). Where the piezoelectric element 20*b* is formed by the AD method (S51), the heat treatment is conducted at a temperature from 600° C. to 750° C. for about one hour. Where the piezoelectric element 20*b* is formed by the sol-gel method (S52), the heat treatment is conducted at a temperature from 600° C. to 1200° C. for about 0.1 to 10 minutes, using an RTA (rapid thermal annealing) furnace.

In the present embodiment, the component which is carried in the annealing step (S6) has increased rigidity as explained above, the constituent members of the component do not suffer from separation or deformation even after the high-temperature heat treatments described above in the annealing step (S6).

The annealing step (S6) is followed by the electrode printing step (S7) in which the individual electrodes 24 are formed on the upper surface of the piezoelectric element 20*b*. The upper surface of the piezoelectric element 20*b* is covered with a masking member which is patterned such that the masking member has through-holes corresponding to the individual electrodes 24 to be formed in alignment with the respective liquid chambers 16. Then, electrode, paste is printed on the masking member patterned as described above to form the individual electrodes 24. The paste printed on respective portions of the upper surface of the piezoelectric element 20*b* corresponding to the respective liquid chambers 16 is first dried under predetermined conditions, and then fired into respective metallic layers.

Subsequently, the polarizing step (S8) is carried out to polarize respective portions of the piezoelectric element 20*b* sandwiched by the individual electrodes 14 and the oscillating plate 20*a*, so as to provide the active portions explained above. In this polarizing step (S8), the flexible flat cable 40 is installed on the piezoelectric element 20*b*, and the individual electrodes 24 formed in the electrode printing step (S7) are electrically connected to the wires of the flexible flat cable 40 corresponding to the respective individual electrodes 24. Then, a voltage higher than that when applied in the ink ejection operation is applied to the piezoelectric element 20*b* while the individual electrodes 24 are connected to the positive electrode and the oscillating plate 20*a* is connected to the ground. As a result, the piezoelectric element 20*b* is polarized in a direction perpendicular to the plane of the oscillating plate 20*a*, i.e., in the direction of thickness of the piezoelectric element 20*b*, from the upper surface of the piezoelectric element 20*b* toward the oscillating plate 20*a*. Thus, there are formed the active portions which undergo a strain upon application of a voltage thereto at the respective portions of the piezoelectric layer 20*b*.

The polarizing step (S8) is followed by the assembling step (S9) in which the cavity plate 14 on which the polarized pressure applying member 20 is superposed is bonded by an adhesive to other plates partially constituting the ink storing portion 10. In the other plates, the manifold chambers, communication holes, etc., are formed, in advance, by etching. Thus, the piezoelectric ink jet recording head 6 in which the pressure applying member 20 is superposed on the ink storing portion 10 is produced. The thus produced piezoelectric ink jet recording head 6 is installed on a main body of an ink jet recording apparatus.

In the ink jet recoding head 6 and the method of producing the same according to the illustrated embodiment, the oscillating plate 20*a* and the cavity plate 14 are provided by the clad member in which the respective metal rolled sheets having mutually different degrees of resistance to etching are superposed or laminated on each other. This arrangement permits the liquid chambers 16 to be formed by etching with high accuracy, resulting in improvement of the recording characteristics of the piezoelectric ink jet recording head 6.

Since the oscillating plate 20*a* and the cavity plate 14 are provided by the clad member explained above, the oscillating plate 20*a* and the cavity plate 14 can sufficiently withstand the treatments conducted in the PZT-layer forming step (S5) and the annealing step (S6) described above. Thus, the piezoelectric ink jet recording head 6 having the thin-type piezoelectric element 20*b* can be produced according to the present invention.

Where the piezoelectric element 20*b* is formed by the AD method (S51) or the sol-gel method (S52) employed in the present invention, the piezoelectric element 20*b* whose thickness is in a range of about 3 μm to about 20 μm can be effectively and stably formed. Therefore, the present invention permits the production of the liquid delivering apparatus that can deliver the liquid by application of a relatively low voltage to the piezoelectric element 20*b*.

The piezoelectric layer for the element 20*b* formed by the AD method (S51) or the sol-gel method (S52) is subjected to the annealing step (S6), so that the piezoelectric characteristics of the piezoelectric element 20*b* can be improved.

While the preferred embodiment of the present invention has been described above, for illustrative purpose only, it is to be understood that the invention is not limited to the details of the illustrated embodiment, but may be embodied with various changes, modifications and improvements, which may occur to those skilled in the art, without departing from the spirit and scope of the invention defined in the attached claims.

In the illustrated embodiment, the clad member consisting of the first metal rolled sheet (the cavity plate 14) formed of stainless steel and the second metal rolled sheet (the oscillating plate 20*a*) formed of titanium alloy is subjected to the etching treatment with the etching agent of ferric chloride, so that the liquid chambers 16 are formed in the cavity plate 14 by etching. The first metal rolled sheet may be formed of aluminum alloy. Further, a clad member consisting of a first metal rolled sheet formed of titanium alloy and a second metal rolled sheet formed of stainless steel may be subjected to the etching treatment with an etching agent of hydrofluoric acid, so that the liquid chambers 16 are formed in the first metal rolled sheet by etching.

Moreover, a clad member consisting of a first metal rolled sheet formed of nickel alloy and a second metal rolled sheet formed of titanium alloy may be subjected to the etching treatment with an etching agent of hydrochloric acid to which ferric chloride is added, so that the liquid chambers 16 are formed in the first metal rolled sheet by etching.

In the illustrated embodiment, the clad member in which the two metal rolled sheets are bonded to each other is used as the laminated member consisting of the oscillating plate 20*a* and the cavity plate 14. The material of the laminated member is not limited to the metals. Various laminated members in which two sheets or layers having mutually different etching characteristics are laminated may be used. For instance, there may be used a laminated member in which the first layer (cavity plate 14) formed of a glass material and the second layer (oscillating plate 20*a*) formed of a ceramic material, which layers have respective different etching characteristics, are bonded or integrally sintered to each other. In this laminated member, only the first layer (cavity plate 14) is etched with the etching agent of hydrofluoric acid. Further, there may be used a laminated member in which the first layer formed of a glass material and the second layer formed of a metal material are bonded integrally to each other. In this laminated member, only the first layer (cavity plate 14) is etched with the etching agent of hydrofluoric acid. Moreover, there may be used a laminated member in which the first layer formed of a metal material and the second layer formed of a ceramic material, or the first layer formed of a metal material and the second layer formed of a glass material, are bonded by anodic bonding or sintering. In the laminated member, only the first layer (cavity plate 14) is etched with the etching agent of ferric chloride. Examples of the metal material include stainless steel, aluminum alloy, nickel alloy, and titanium alloy. Examples of the glass material include boro-silicated glass. Examples of the ceramic material include alumina and zirconia. In the laminated members described above, where the second layer (oscillating plate 20*a*) is formed of the ceramic material or the glass material, a layer of an electrically conductive material is formed, prior to formation of the piezoelectric element 20*b*, on the oscillating plate 20*a* by a suitable method such as plating, vapor deposition, or sputtering, for thereby giving conductivity to the oscillating plate 20*a*.

Figure 7:
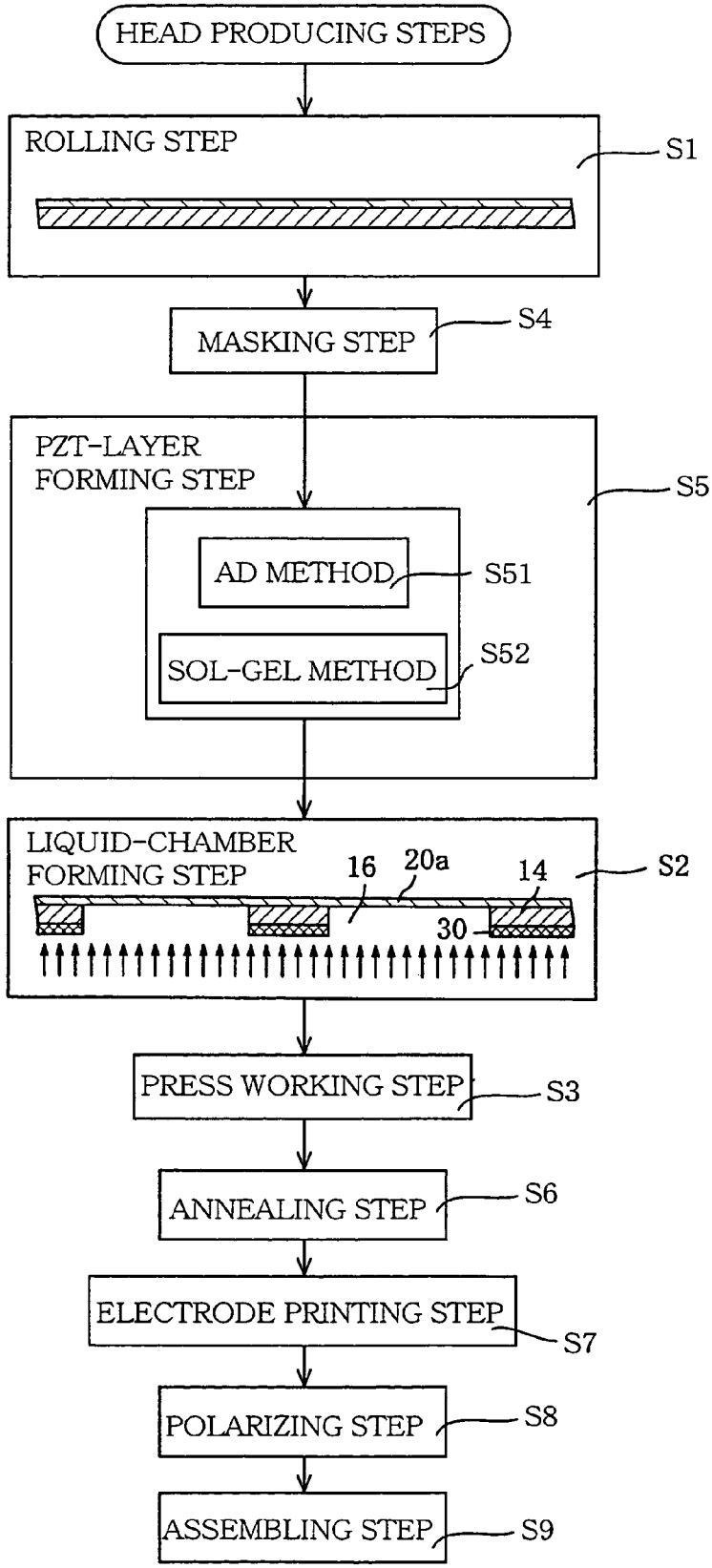
FIG. 7 is a view showing another process steps for producing the piezoelectric ink jet recording head.

In the method of producing the piezoelectric ink jet recording head 6 according to the illustrated embodiment, the piezoelectric element 20*b* is formed in the PZT-layer forming step (S5) after the liquid chambers 16 have been formed in the liquid-chamber forming step (S2). As shown in FIG. 7 which shows process steps of producing the ink jet recording head 6 according to another embodiment of the present invention, the masking step (S4) and the PZT-layer forming step (S5) may be conducted prior to the liquid-chamber forming step (S2). In this case, the clad member on which the piezoelectric element 20*b* is formed is subjected to the etching operation, so that the liquid chambers 16 are formed in the cavity plate 14 by etching. According to this arrangement, the piezoelectric element 20*b* can be formed on the oscillating plate 20*a* having further increased degrees of resistance to heat and impact.

The methods according to the present embodiment are applied to not only the case in which a set of plate members which have been processed into respective suitable shapes are used to produce a single ink jet recording head 6, but also a case in which a plurality of sets of plate members that are connected to each other in a matrix form are used to produce a plurality of ink jet recording heads 6 formed as an integral body. In the latter case, the produced integral body is divided into individual ink jet recording heads 6 by dicing, after the polarizing step (S8) and prior to the assembling step (S9).

In the illustrated embodiment, a step of cleaning the oscillating plate 20*a* and a step of conducting a primer treatment may be carried out before the PZT-layer forming step (S5), in order to improve adhesion of the oscillating plate 20*a* with respect to the piezoelectric element 20*b* to be formed thereon.

In the illustrated embodiment, as the two manifold plates 11, 12 and the spacer plate 13, the metal plate members are used. There may be used other plate members such as a glass plate member, a ceramic plate member, and a resin plate member formed of resin that has a resistance to corrosion to the ink. Where the glass plate member and the ceramic plate member are used in combination, green sheets of the respective plate members are laminated on and sintered integrally to each other. Accordingly, the plate members when sintered are not mutually independent members, but provide an integral body.

While the liquid delivering apparatus in the form of the ink jet recording head 6 has been described above as the preferred embodiment of the present invention, the principle of the invention is equally applicable to various types of apparatus, provided that the apparatus is arranged to deliver liquid by applying pressure to the liquid owing to deformation of the piezoelectric element.

What is claimed is:

1. A liquid delivering apparatus comprising:

at least one piezoelectric element which deforms upon application of a drive voltage thereto;

an oscillating plate on which said at least one piezoelectric element is laminated and which is oscillated by deformation of said at least one piezoelectric element; and at least one liquid chamber which stores liquid and which is formed adjacent to said oscillating plate on one of opposite sides thereof that is remote from said at least one piezoelectric element, the liquid in the liquid chamber being given pressure by the deformation of said at least one piezoelectric element, so that the liquid is delivered to an exterior of the apparatus, wherein said at least one liquid chamber is formed in a laminated member including a first layer and a second layer that are bonded integrally to each other, such that at least one portion of the first layer forming at least part of said at least one liquid chamber is recessed by etching to such an extent that at least one portion of the second layer corresponding to said at least one portion of the first layer is exposed from the recessed portion of the at least one portion of the first layer to form a cover of the at least one liquid chamber, the second layer constituting the oscillating plate and having resistance to conditions under which the first layer is etched, and wherein the first layer is formed of one of metal and glass.

2. The liquid delivering apparatus according to claim 1, further comprising at least one individual electrode, at least a portion of said at least one piezoelectric element which is interposed between said at least one individual electrode and the oscillating plate being polarized so as to give at least one active portion that is deformed with respect to said at least one liquid chamber, said oscillating plate having at least one oscillating portion which is oscillated by deformation of said at least one active portion.

3. The liquid delivering apparatus according to claim 1, wherein a combination of respective materials of the first layer and the second layer is one of stainless steel and titanium alloy; aluminum alloy and titanium alloy; nickel alloy and titanium alloy; titanium alloy and stainless steel; glass and ceramic; glass and metal; metal and ceramic; metal and glass.

4. The liquid delivering apparatus according to claim 1, wherein the metal is one of stainless steel, aluminum alloy, nickel alloy, and titanium alloy.

5. The liquid delivering apparatus according to claim 1, wherein the glass is boro-silicated glass.

6. The liquid delivering apparatus according to claim 3, wherein the ceramic is alumina or zirconia.

7. The liquid delivering apparatus according to claim 1, wherein the first layer is formed of stainless steel and the second layer is formed of titanium alloy, the first layer being etched by using ferric chloride as an etching agent.

8. The liquid delivering apparatus according to claim 1, wherein the first layer is formed of titanium alloy and the second layer is formed of stainless steel, the first layer being etched by using hydrofluoric acid as an etching agent.

9. The liquid delivering apparatus according to claim 1, wherein said at least one piezoelectric element has a thickness of about 3 μm to about 20 μm.

10. The liquid delivering apparatus according to claim 1, wherein the second layer of the laminated member which constitutes the oscillating plate has a thickness of about 10 μm to about 50 μm.

11. The liquid delivering apparatus according to claim 1, wherein the first layer of the laminated member in which said at least one liquid chamber is formed has a thickness of about 50 μm to about 150 μm.

12. The liquid delivering apparatus according to claim 1, wherein the liquid stored in said at least one liquid chamber is ink and the liquid delivering apparatus further comprises at least one nozzle which communicates with said at least one liquid chamber and from which the ink is ejected to the exterior of the apparatus, the liquid delivering apparatus constituting an ink jet recording head.

13. The liquid delivering apparatus according to claim 1, wherein the first layer is formed of metal.

14. The liquid delivering apparatus according to claim 1, wherein the at least one piezoelectric element covers an entirety of a portion of a major surface of the oscillating plate, the portion of the major surface corresponding to an entirety of the exposed portion of the second layer.

15. The liquid delivering apparatus according to claim 14, wherein the at least one liquid chamber comprises a first liquid chamber and a second liquid chamber, the exposed portion of the second layer comprises a first exposed portion to cover in the first liquid chamber and a second exposed portion to cover in the second liquid chamber, and the portion of the major surface corresponds to an entirety of both the first exposed portion and the second exposed portion.

* * * * *